United States Patent [19]

Mills

[11] Patent Number: 4,739,529

[45] **Date of Patent: * Apr. 26, 1988**

[54] CONVERTIBLE DOLL AND SLEEPING BAG

[76] Inventor: Carol B. Mills, 6830 Trexler Rd., Lanham, Md. 20706

[ * ] Notice: The portion of the term of this patent subsequent to Jul. 10, 2001 has been disclaimed.

[21] Appl. No.: 65,111

[22] Filed: Jun. 23, 1987

Related U.S. Application Data

[63] Continuation of Ser. No. 601,395, Apr. 17, 1984, abandoned, which is a continuation-in-part of Ser. No. 493,191, May 10, 1983, Pat. No. 4,458,372.

[51] Int. Cl.[4] ..... A47C 29/00; A63H 3/02

[52] U.S. Cl. ..... 5/413; 446/369; 446/72; 446/73; 2/69.5

[58] Field of Search ..... 5/413, 419, 420, 417, 5/440; 2/69.5, 84, 85, 86, 94; 224/151, 152, 156; 446/72, 73, 369, 371, 374

[56] References Cited

U.S. PATENT DOCUMENTS

| | | | |
|---|---|---|---|
| D. 226,101 | 1/1973 | Marcus . | |
| D. 256,202 | 8/1980 | Schmickel et al. . | |
| 424,587 | 4/1890 | Whitney | 446/374 |
| 1,575,263 | 3/1926 | Guglielmi . | |
| 2,183,418 | 12/1939 | Williams . | |
| 2,195,127 | 3/1940 | Brucker | 46/153 |
| 2,315,126 | 3/1943 | Michalke . | |
| 2,655,762 | 10/1953 | Burke . | |
| 2,678,505 | 5/1954 | Munson . | |
| 2,791,775 | 5/1957 | Sartel . | |
| 2,971,205 | 2/1961 | Shultz | 5/416 |
| 3,176,315 | 4/1965 | Freund | 5/417 |
| 3,447,165 | 6/1969 | Brosk . | |
| 3,477,552 | 11/1969 | Goldman . | |
| 3,774,249 | 11/1973 | Ybarra et al. . | |
| 3,789,546 | 2/1974 | Morrison . | |
| 3,811,220 | 5/1974 | Glass et al. | 446/371 |
| 3,851,419 | 12/1972 | Kaelin . | |
| 3,864,871 | 2/1975 | Kaelin . | |
| 3,955,309 | 5/1976 | Noble . | |
| 4,236,263 | 12/1980 | Allee . | |
| 4,404,689 | 9/1983 | De Wan | 2/94 |
| 4,458,372 | 7/1984 | Mills . | |
| 4,476,587 | 10/1984 | Itoi | 2/94 |
| 4,543,669 | 10/1985 | Katz | 446/369 |

*Primary Examiner*—Gary L. Smith
*Assistant Examiner*—Vinh Luong
*Attorney, Agent, or Firm*—Dowell & Dowell

[57] ABSTRACT

A sleeping bag having an image of a doll attached to the upper surface thereof which image includes separate arm and leg appendages which are secured to the upper surfaces of the sleeping bag and at least one selectively opening panel member which defines the body portion of the doll and which is secured to the upper surface of the sleeping bag in such a manner that when in a first position it defines a pocket in which various articles may be stored and when in a second position the sleeping bag may be folded and received and enclosed therein to thereby form a doll having three-dimensional characteristics. In an alternate embodiment the head of the doll is attached to an edge of the sleeping bag so as to form a pillow when the sleeping bag is in use.

15 Claims, 6 Drawing Sheets

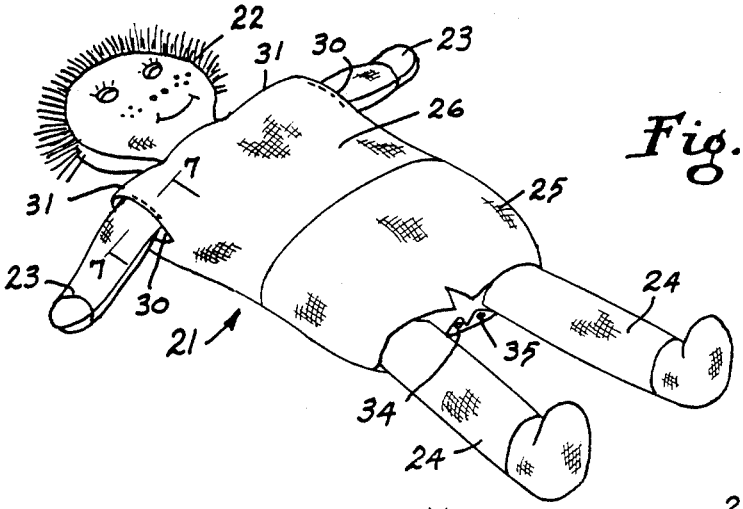
Fig. 1
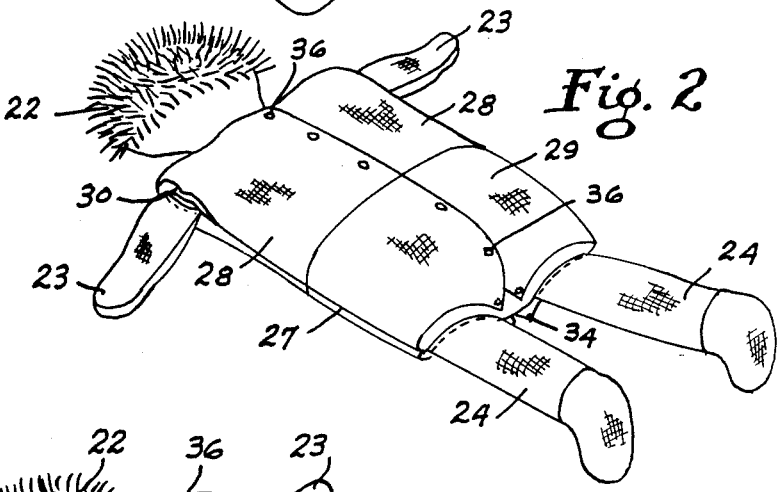
Fig. 2
Fig. 3
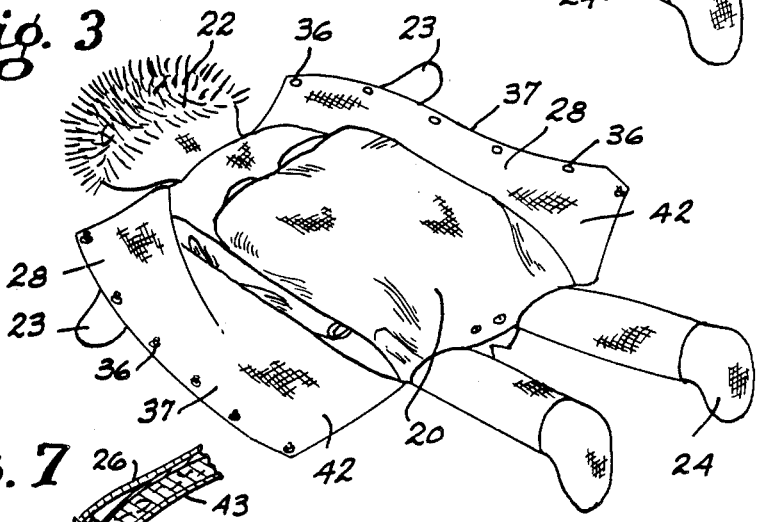
Fig. 7
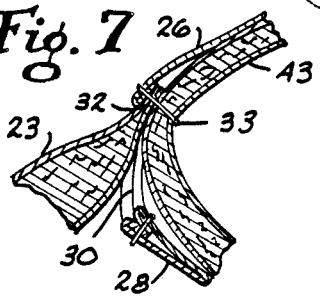

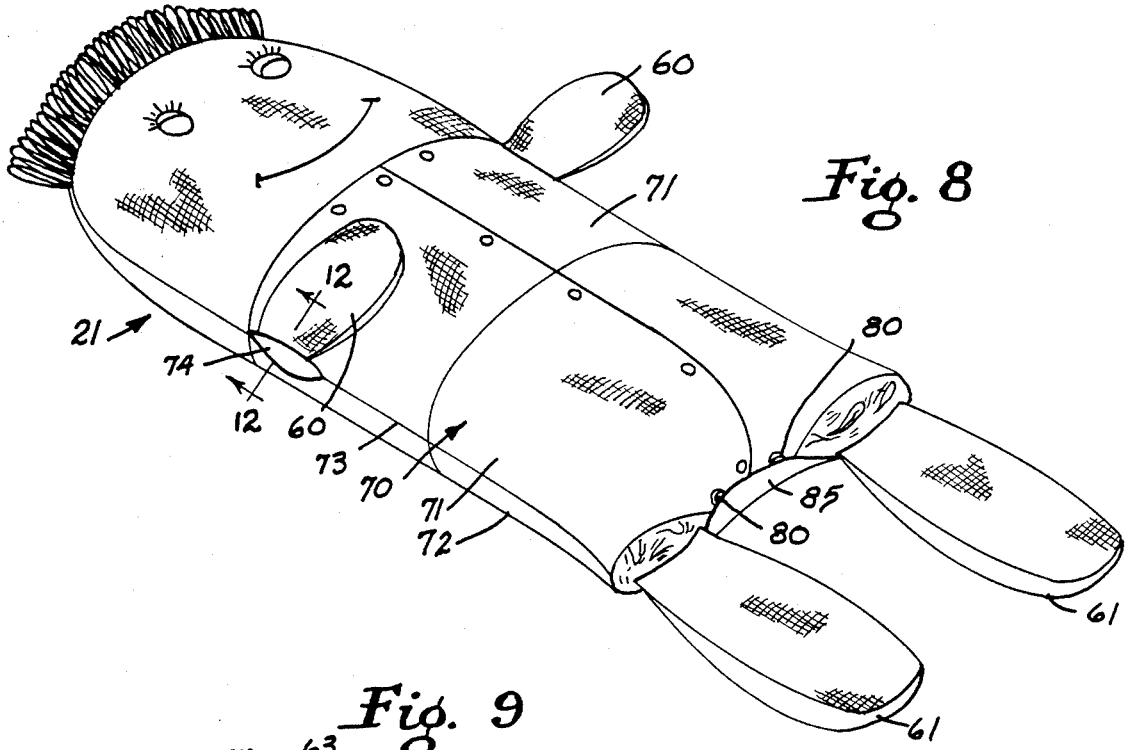
Fig. 8
Fig. 9
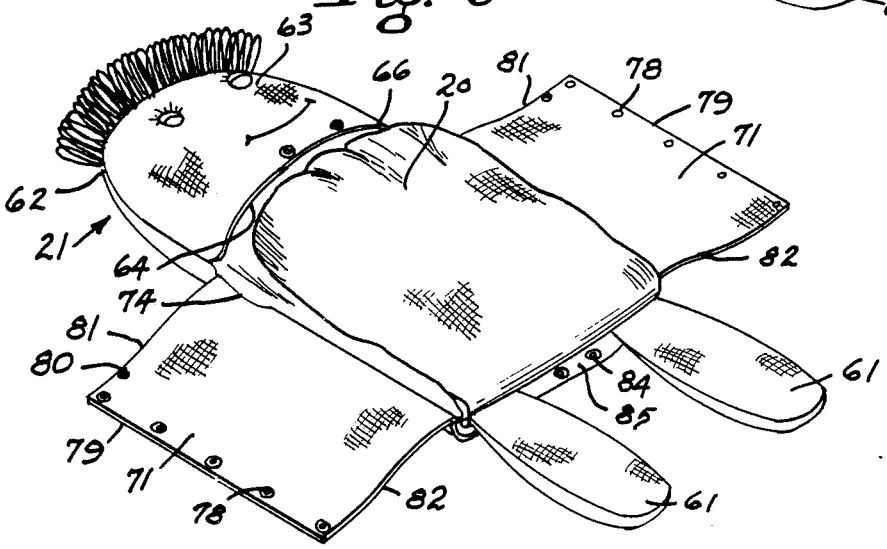
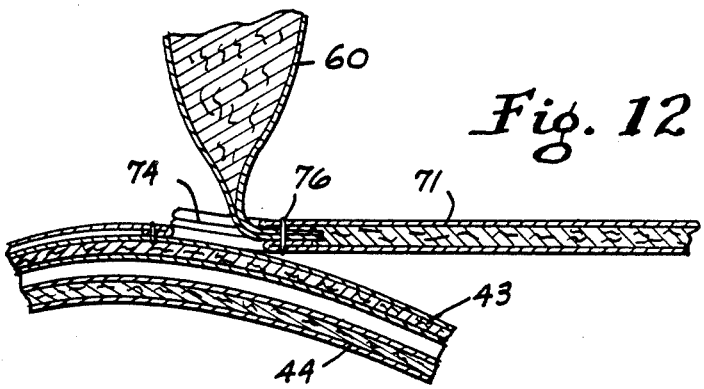
Fig. 12

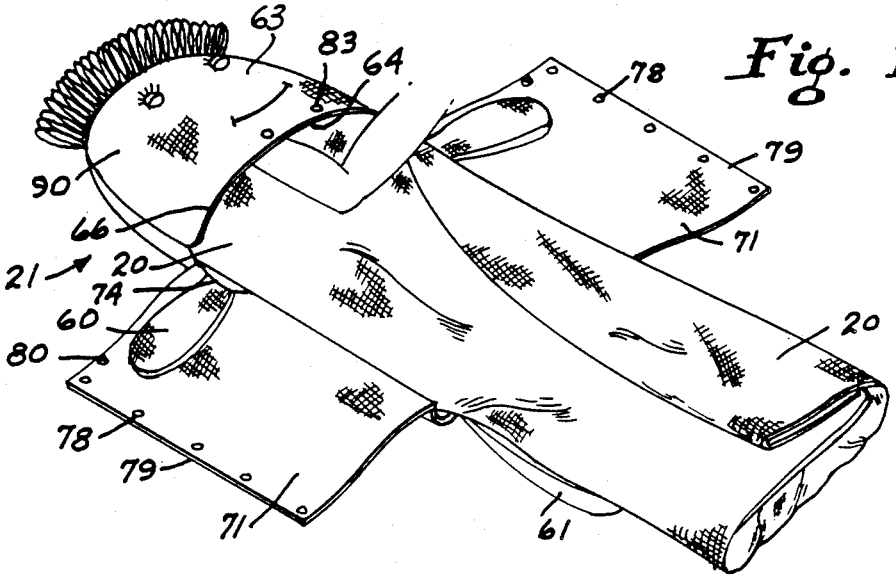
Fig. 10
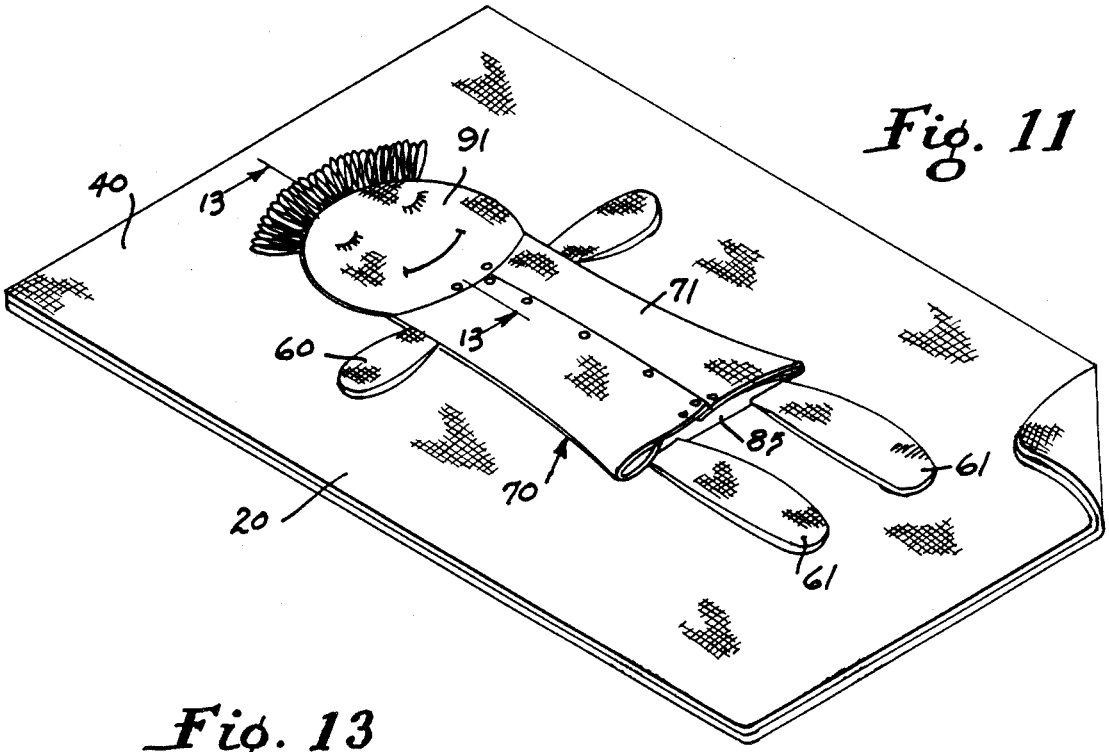
Fig. 11
Fig. 13
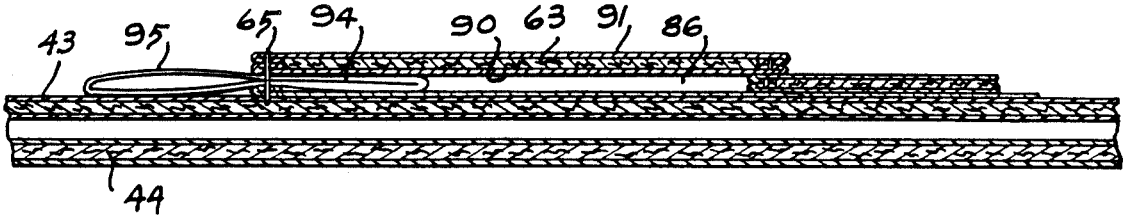

CONVERTIBLE DOLL AND SLEEPING BAG

REFERENCE TO RELATED APPLICATIONS

This application is a continuation of application Ser. No. 601,395, filed Apr. 17, 1984, now abandoned, which is a continuation-in-part of Ser. No. 493,191, filed May 10, 1983, now U.S. Pat. No. 4,458,372, issued July 10, 1984.

BACKGROUND OF THE INVENTION

1. Field of the Invention

This invention is generally related to bedding apparatus such as sleeping bags, sleeping blankets, rugs, and the like, and particularly to such bedding apparatus which are convertible to form a three-dimensional doll when folded and enclosed in a nonuse position.

2. History of the Art

The concept of creating articles of bedding including sleeping bags, lap robes, blankets and the like which may be folded when not in use and stored to create an object having a utility other than that for which it was primarily designed, is generally known in the prior art. In applicant's pending U.S. patent application Ser. No. 429,638, filed Sept. 30, 1982 now abandoned, there is disclosed a convertible sleeping bag and stuffed toy which is designed and constructed so as to be especially appealing to children. In such pending application, the sleeping bag includes a shaped pouch or pocket which is attached to the sleeping bag and which selectively receives the sleeping bag therein to form a three-dimensional figure when the sleeping bag is tucked into a nonuse position.

In U.S. Pat. No. 1,575,263 to Guglielmi, there is disclosed a combined coverlet and doll in which the coverlet has a doll attached thereto. When the coverlet is rolled up, it may be selectively secured in a rolled configuration behind the doll. The doll, however, does not receive or enclose the sleeping bag therein and thus the rolled sleeping bag is always exposed and visible.

Other prior developments in sleeping bags for children are exemplified by U.S. Pat. Des. Nos. 256,202 to Schmickel et al., and 4,236,263 to Allee. The Schmickel et al. patent discloses a sleeping bag in the configuration of a fish, and the Allee patent discloses a sleeping bag having an image of a creature such as an alligator which is formed on the surface and extends from the sides thereof. However, neither of the foregoing prior art patents provide means for receiving and enclosing the sleeping bag to create a separate three-dimensional doll or doll like character when the sleeping bag is not in use.

Other examples of combined or convertible sleeping bags mats, robes, and the like are disclosed in U.S. Pat. Nos. 2,791,775 to Sartell, and 3,477,552 to Goldman. In each of these patents the robe or mat is selectively folded and received within pockets which are attached thereto so that the resultant article resembles a tote bag.

SUMMARY OF THE INVENTION

This application is directed to a sleeping bag which is convertible to a doll wherein at least one panel which defines a body portion of a doll image is secured to the surface of the sleeping bag in such a manner that the panel may be selectively opened and closed with respect to the sleeping bag so that when the sleeping bag is not in use it may be selectively folded, retained and enclosed by such portion of the doll to thereby create or form a three-dimensional doll like configuration. In an alternate embodiment of the invention, the head of the doll is attached to an edge of the sleeping bag and functions as a pillow when the sleeping bag is in use, It is the primary object of this invention to provide a sleeping bag which may be selectively convertible to a three-dimensional doll like character when folded and stored in a nonuse position.

It is another object of this invention to provide a sleeping bag having an image of a doll attached to the surface thereof. Such doll having a body portion defined by at least one selectively movable panel member which may be opened and closed to house articles such as clothing or toys therein when the sleeping bag is extended into a use position.

It is a further object of the present invention to provide a sleeping bag having an image of a doll like character secured thereto in such a manner that the arm and leg appendages may be freely movable with respect to the sleeping bag when the sleeping bag is in a use position and in which the sleeping bag may be selectively stored within the body portion of the doll when not in use to thereby create a three-dimensional doll like toy.

It is another object of this invention to provide a sleeping bag which is convertible to a three-dimensional doll so that the sleeping bag has special appeal to children and may be used either as an article of bedding or as a child's toy.

It is yet another object of the present invention to provide a sleeping bag which is convertible to a doll in which at least one panel which forms the image of the body of the doll is removably secured to the surface of the sleeping bag so that the image of the doll may be selectively changed.

BRIEF DESCRIPTION OF THE DRAWINGS

FIG. 1 is an illustration of one form of the invention in which the sleeping bag has been selectively stored to form a doll like configuration.

FIG. 2 is an illustration showing the backside of the doll shown in FIG. 1.

FIGS. 3 through 6 are step-by-step illustrations showing the sleeping bag portion of the invention as it is unfolded and extended for use from within the body portion of the doll of FIG. 1.

FIG. 7 is a partial cross-sectional view taken along the lines 7—7 of FIG. 1.

FIG. 8 is an illustration of a modified form of the invention showing the sleeping bag stored within the head and body portions of the doll-like character.

FIGS. 9–11 are step-by-step illustrations of the modified form of the invention shown in FIG. 8 showing the sleeping bag being pulled from the head and body portions of the doll-like character.

FIG. 12 is an enlarged partial cross-sectional view taken along the lines of 12—12 of FIG. 8.

FIG. 13 is an enlarged partial cross-sectional view taken along the lines 13—13 of FIG. 11

DESCRIPTION OF THE PREFERRED EMBODIMENT

Figure 4:
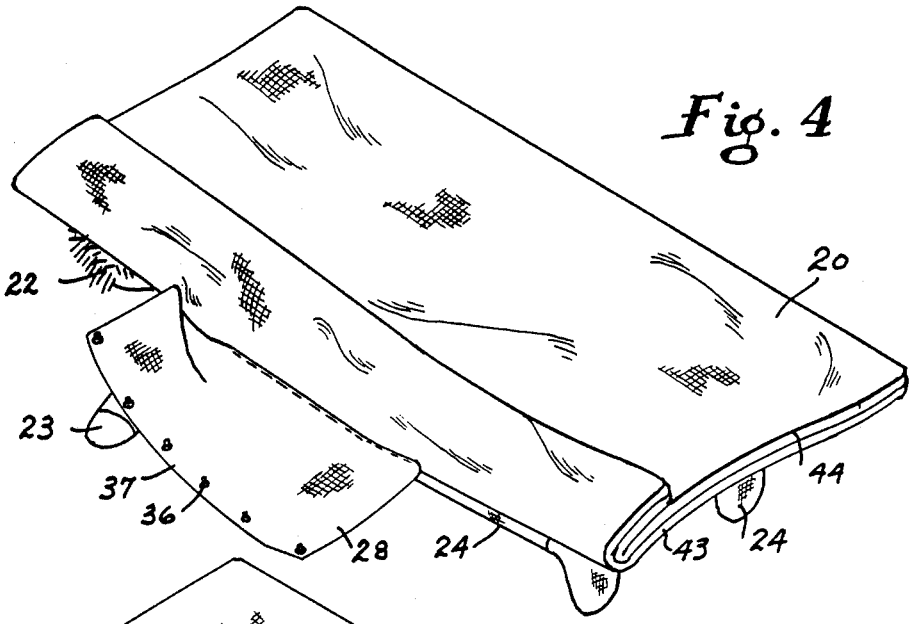

With continued reference to the drawings, a child's sleeping bag or blanket 20 is shown in FIGS. 1 and 2 as it is selectively stored in a nonuse position to form a three dimensional doll 21. The doll includes a head 22, arms 23, and legs 24, each of which is formed into a three-dimensional configuration by being stuffed with an appropriate batting material such as a polyester batting. The body portion of the doll 25 includes a front body panel 26 which is secured by stitching along the sides of the doll 27 to a pair of movable panel members 28 which define the back 29 of the doll. A pair of oppositely disposed openings 30 are provided between the front and rear panel members adjacent what would be defined as the shoulder areas 31 of the body portion of the doll through which the arms 23 may be selectively extended. As shown in FIG. 7, the arms 23 are secured at their innermost end 32 to the front body panel member 26 by stitching 33.

In order that the panels defining the body of the doll may completely cover and surround the area adjacent the legs, the rear panel portions include flange members 34 which extend between the legs of the doll and which may be selectively secured to the front panel portion 26 by any conventional separable engaging means such as snaps 35.

With particular reference to FIGS. 2 through 6, the technique by which the sleeping bag 20 is unfolded from between the movable panel members 28 is illustrated. The rear movable panel members 28 are selectively joined by any conventional selectively operable securing means such as by use of a plurality of male and female friction snaps generally indicated at 36 which are secured to the outermost edge portions 37 of the panel members. When it is desired to utilize the sleeping bag the snaps 36 are pulled from engagement with one another and the rear body panels 28 are extended outwardly, as shown in FIG. 3, exposing the folded sleeping bag 20. The sleeping bag is subsequently unfolded and extended outwardly relative to the length and width of the doll. The sleeping bag is then inverted so that the upper surface 40 thereof is oriented away from a supporting surface. At this point, the head and legs of the doll will be oriented outwardly with respect to the upper surface 40 of the sleeping bag, however, the arms of the doll remain oriented between the panel members 28 (see FIG. 5). It is, therefore, necessary to extend the arms 23 through the openings 30 between the front and rear panel members so that the arms extend outwardly of the movable panel members. Thereafter the movable panel members are closed relative to one another and secured by the snaps 36. From the foregoing, when the sleeping bag is in a use position, the body portion of the doll is defined by the inner surfaces 42 of the movable rear body panels 28.

Figure 5:
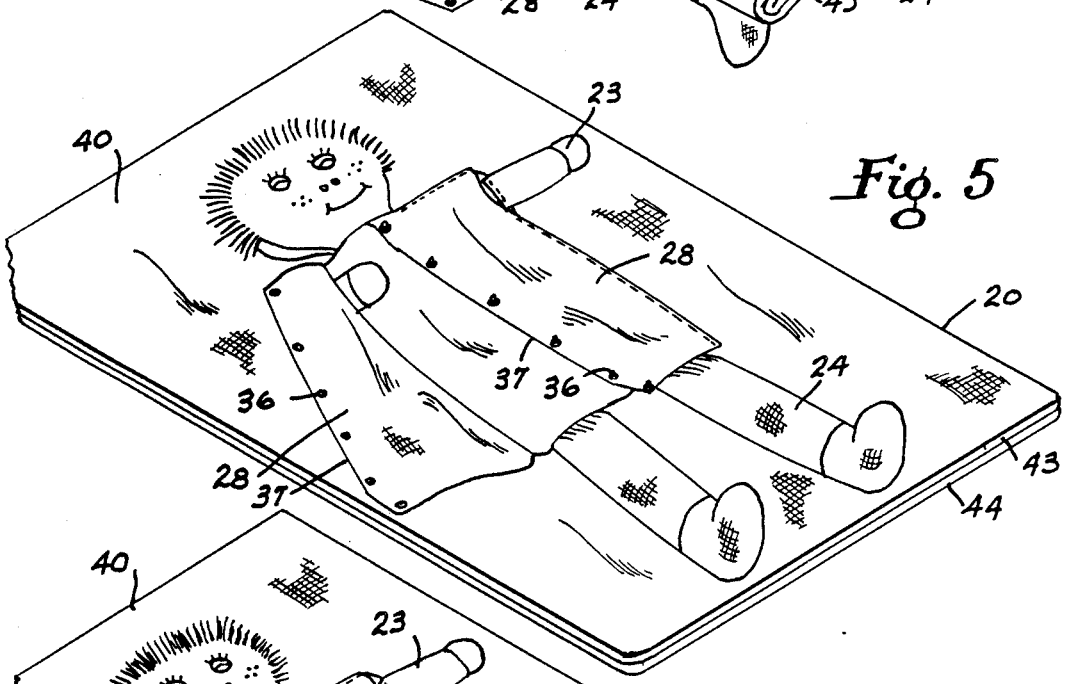
Figure 6:
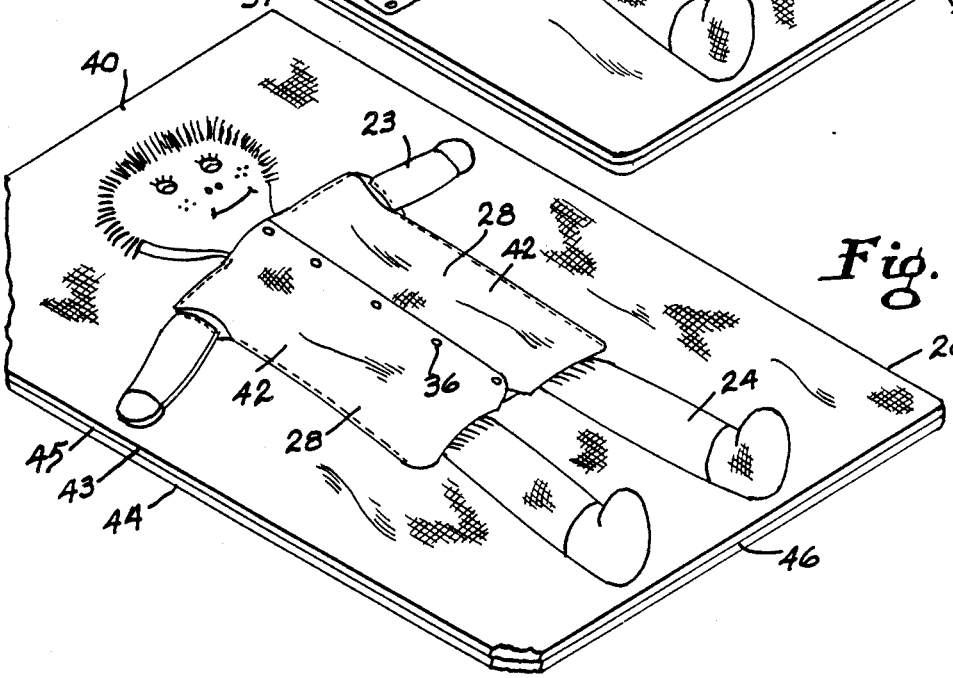

As shown in FIG. 5, the sleeping bag includes upper and lower sections 43 and 44 which are selectively joined along the sides 45 and one end 46 of the sleeping bag by a zipper or other suitable fastening means (not shown). In construction the sleeping bag may be manufactured using a poplin cover material having a lining between which a polyester batting is provided although any other suitable material batting may be used.

In the embodiment of the invention described, and as shown in FIG. 7, the front panel member of the doll 26 is secured by stitching to the upper surface 40 of the upper section 43 of the sleeping bag. The head and legs are likewise secured between the upper surface of the sleeping bag and the body panel 26 by stitching and are, therefore, movable or pivotal with respect to the upper surfaces of the sleeping bag.

Although the length of the sleeping bag is shown as being not too much greater than the height of the doll, the sleeping bag may be made larger. However, the sleeping bag is preferably one of a size which is particularly adapted for young children. Also, although the preferred embodiment of the invention is directed to a doll and sleeping bag combination, it should be noted that the sleeping bag need not be of conventional configuration, but may be in the form of a blanket or sleeping pad, and may be of any desired shape such as rectangular, oblong, or itself simulative of any object, character or other design. In this regard younger school aged children in nursery or preschool are frequently requested to bring a pad or rug to school for purposes of taking short naps or breaks. The invention is equally applicable to a convertible child's blanket or rug and a doll. In such instances the sleeping bag would be constructed of a single thickness of material as opposed to the traditional sleeping bag configuration. In addition, the doll could be in the form of a stuffed toy or animal such as a bear or the like.

With specific reference to FIGS. 8 through 13 an alternate embodiment of the invention is disclosed. In the alternate embodiment, the doll 21 includes outwardly extending arms 60 and legs 61 which are filled or stuffed with a conventional batting material. The head 62 is formed having face panel 63 which is joined to the outer surface 40 of the sleeping bag as indicated at 65 by stitching to form a pocket or envelope 64 which is open along the lower edge portion 66 of the face panel 63 and which receives a first portion of the sleeping bag therein as will be more fully described hereinafter.

The body portion of the doll 70 is defined having a pair of front panels 71 which are movable relative to one another and which are connected such as by stitching to a rear panel 72 which forms the back of the body portion of the doll as indicated at 73. An opening 74 is provided between each of the movable panel portions 71 and the rear panel portion 72 in the area adjacent the arms 60 of the doll. When the invention is in a configuration of a doll, the arms 60 are secured to each of the movable panel members 71 by stitching 76 as shown in FIG. 12, and are disposed adjacent each or the openings 74 so as to be forwardly of the openings when viewed from the front of the doll. Also, although the legs 61 are shown as being attached to the upper surface of the sleeping bag, the legs may be selectively attached to the movable panel members 71.

In order to completely enclose the sleeping bag 20 within the doll and to retain the same therein, conventional fastening means such as snaps 78 are disposed along the outermost edge portions 79 of each of the movable panel members 71 with the snap members 78 of each of the panel members 71 being selectively engageable with the opposing snap members of the adjacent panel member 71. Additional fastening means and snap members 80 are provided along the upper and lowermost edges 81 and 82 of each of the panel members 71. The snap members 80 are selectively locked with cooperating snap members 83 and 84 provided adjacent the lower edge 66 of the face panel 63 of the head and a flap portion 85 extending from the rear panel member 72 between the legs 61 of the doll. When the snaps 80 are closed with snaps 83 and 84 the body portion of the doll is closed between the legs of the doll and the head of the doll thereby the doll is a continuous three-dimensional figure.

With particular reference to FIGS. 9 through 11, when it is desired to utilize the sleeping bag 20, the movable panel members 71 are opened relative to one another and a second portion of the sleeping bag is unfolded therefrom outwardly along the length of the doll body. The remainder or first portion of the sleeping bag is then pulled from within the pocket 64 as shown in FIG. 10. As the sleeping bag is pulled from the pocket 64, the pocket will be turned inside out so that the face panel 63 is reversed thereby creating a hollow pocket 86. As the face panel 63 is reversed depending upon whether or not the invention is in the configuration of a doll or sleeping bag, the face panel has first and second facial images 90 and 91 on opposite sides thereof. With reference to FIG. 10, when the invention is in the configuration of a doll, the first facial image is visually displayed and depicts a doll with the eyes opened as if the doll was awake. However, with reference to FIG. 11, when the sleeping bag is in use, the opposite or second facial image is displayed and shows a doll having its eyes closed as if the doll was asleep.

After the sleeping bag has been unfolded and pulled from within the pocket 64, the sleeping bag is inverted or turned over so that the upper surface 40, thereof, is oriented outwardly with respect to the supporting surface. When the sleeping bag is initially inverted, the arms of the doll will be disposed beneath the movable panel members 71. The arms are therefore inserted through the openings 74 between the movable panel member 71 and the rear panel 72. Thereafter, the movable panel members may be snapped or otherwise fastened together. The sleeping bag having a doll image thereon is now ready for use, as shown in FIG. 11. It is apparent that the hollow pocket 86 is defined by the head of the doll and the area beneath the movable panel 71 may be selectively used to store a variety of articles including personal items such as brushes, glasses, toothpaste, and the like as well as articles of clothing or toys.

In order to give the doll and doll image on the sleeping bag a more realistic look, imitation hair may be secured to the top of the doll's head. With particular reference to FIG. 13, as the head portion of the doll is reversible, that is, capable of being turned inside out, the imitation hair should be secured between the face panel 63 and the upper surface of the sleeping bag so as to extend outwardly from both sides of the seam 65. In this manner, when the invention is in the form of a three-dimensional doll, the hair 94 is visible, while when the face panel is turned inside out as the sleeping bag is extended from the pocket 64, the hair shown as 95 will be visible and the hair 94 will be hidden within the hollow pocket 86. The hair 94 has a utility also in that when it is desired to store the sleeping bag in the pocket 64, the user may grasp the hair and use it as a handle to pull the pocket 86 inside out. As an alternative to the hair shown and described, the doll may have ears, a hat or a separate handle member may be used to provide the same function.

Figure 14:
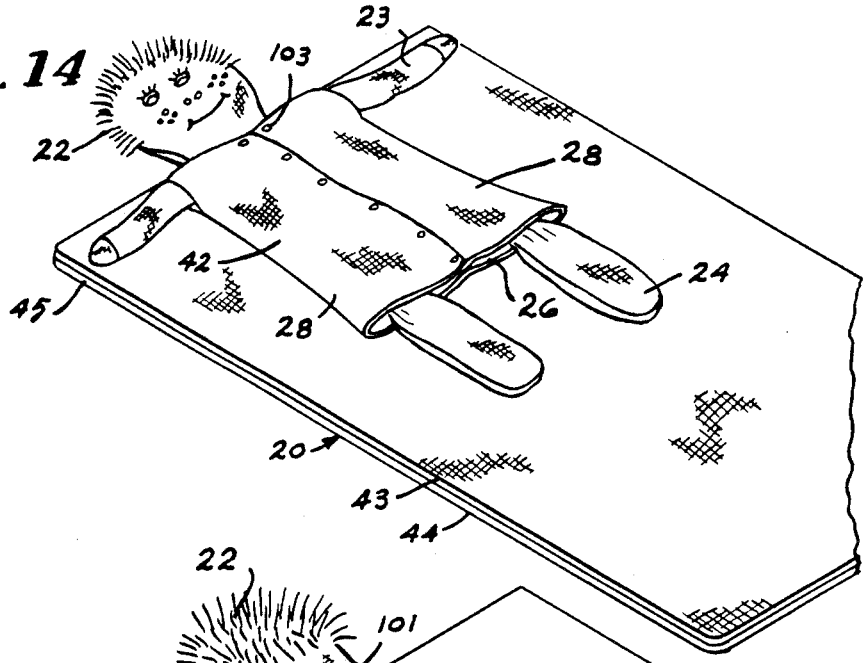
FIGS. 14 and 15 are illustrations of another embodiment of the invention showing the sleeping bag in a normal and extended configuration.
Figure 15:
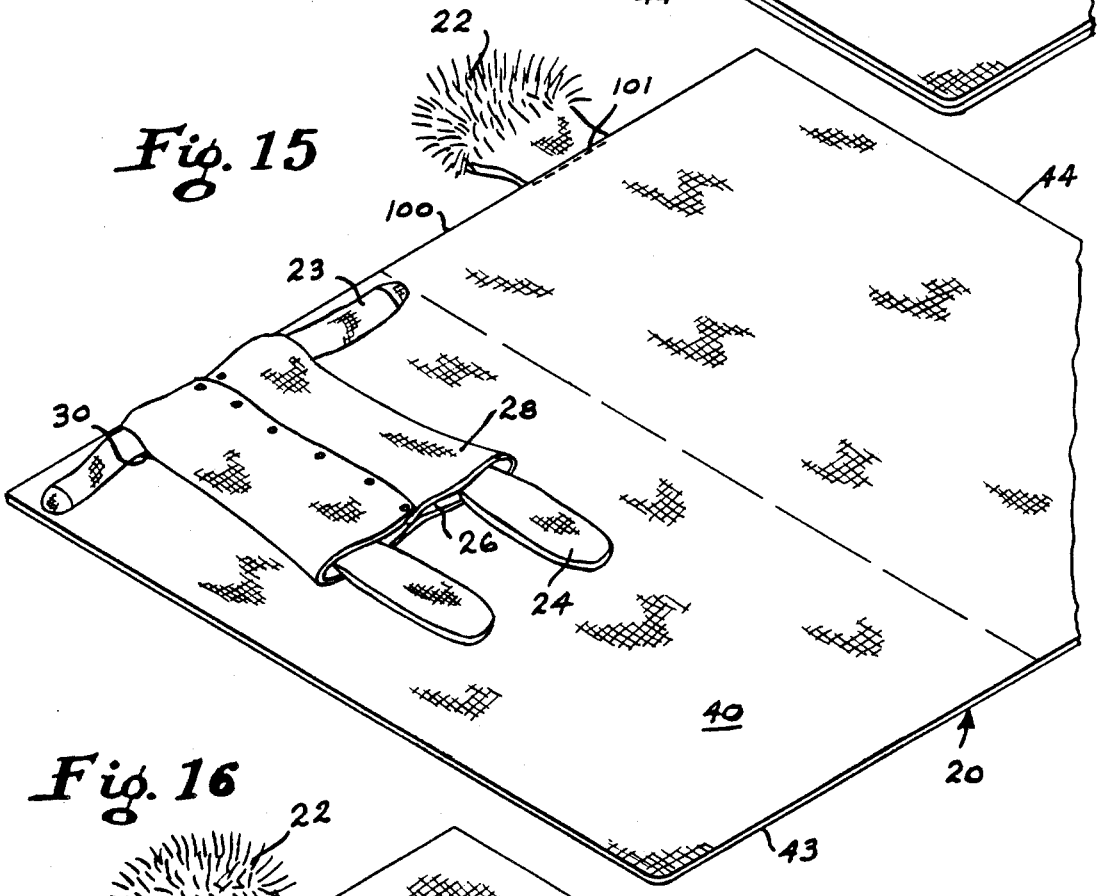
Figure 16:
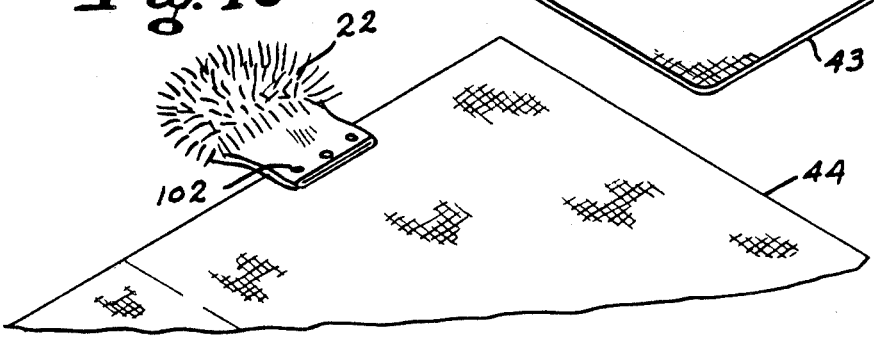
FIG. 16 is a sectional illustration of the modified form of the invention shown in FIGS. 14 and 15.

Another embodiment of the present invention is shown in FIGS. 14–16. In this embodiment of the invention, the structure of the doll and the sleeping bag is closely related to that of FIGS. 1–6, and, therefore, the same reference numbers have been applied to the drawing. With particular reference to FIG. 15, the head 22 is shown as being attached to the upper edge 100 of the sleeping bag and along the lower section 44 thereof as shown at 101. The head 22 should be attached so that the face thereof is oriented upwardly when the lower section 44 of the sleeping bag is folded beneath the upper section 43 as shown in FIG. 14. As the head of the doll is attached to the upper edge 100 of the sleeping bag, the body portion of the doll, as defined by the front body panel 26 and movable panel members 28, is attached to the upper surface of the sleeping bag adjacent the upper edge thereof so as to be cooperatively aligned with the head of the doll when the sleeping bag is in the configuration shown in FIG. 14.

In this embodiment, the head will act as a pillow when the sleeping bag is in use. In this regard, it may be desirable to form the head so that a hollow cavity is created therein into which a pillow or similar padding may be selectively inserted. In FIG. 16, the head 22 is shown as being detachably mounted by snaps 102 to the lower section 44 of the sleeping bag and may be selectively attached to the upper section 43 of the sleeping bag by snaps or other securing means (not shown). As in the previous discussion with respect to FIGS. 1–6, when it is desired to store the sleeping bag, the sleeping bag is folded so as to be oriented adjacent the front panel portion 26. Thereafter, the movable panels 28 are unsnapped from engagement with one another and folded or reversed so as to extend around the sleeping bag and into selective engagement again to enclose the sleeping bag therebetween. When the movable panel members are reversed or moved outwardly from the position shown in FIG. 15, the arms are extended back through the openings 30 so as to permit the panel members 28 to be freely movable behind the arms 23. In order to secure any opening between the head and the upper portion of the body as defined by the movable panel members, a separate set of closure means such as snap fasteners 103 may be provided to join the lower portion of the head 22 to either of the upper portion of the movable and fixed panel members 26 and 28.

Figure 17:
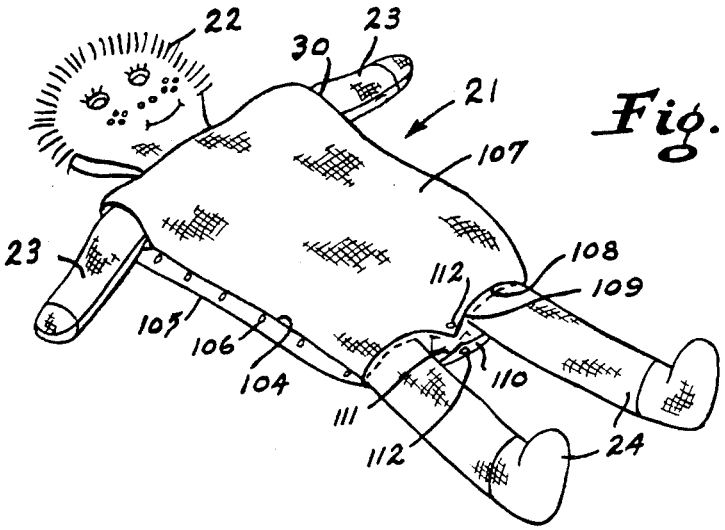
FIGS. 17 and 18 are illustrations of another embodiment of the invention showing a doll-like character having a single body panel member.
Figure 18:
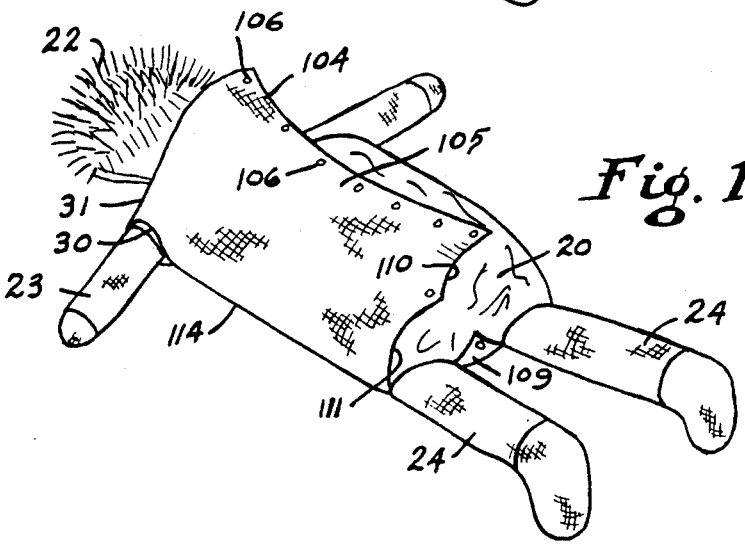
Figure 19:
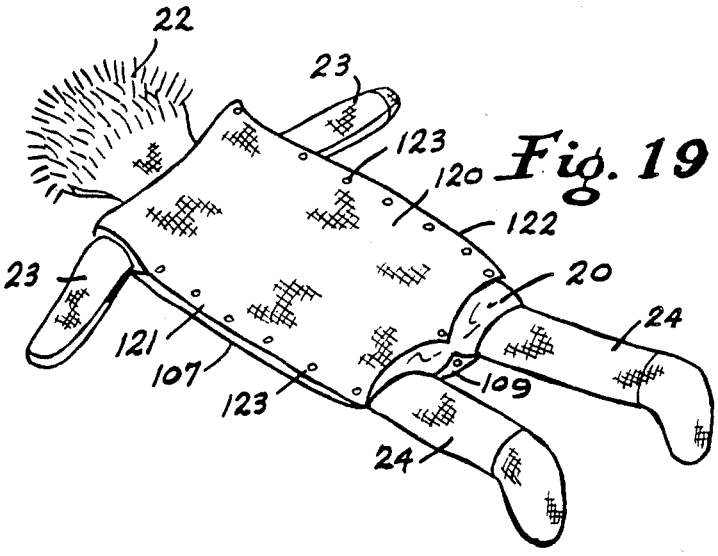
FIG. 19 is an illustration of a modified form of the invention shown in FIGS. 17 and 18.

With specific reference to FIGS. 17–19, a further embodiment of the invention is disclosed. This embodiment is also similar to the embodiment disclosed in FIGS. 1–6 with the exception that the opposing movable panel members 28 have been replaced by a single rear panel member 105. When the invention is in the configuration of a doll, the rear panel 105 is shown as being detachably secured along one edge portion 104 by suitable fastening means 106 to the side of the front panel. The fixed panel 107 forming the front body portion of the doll is tapered along the lower edge portion thereof 108 so as to provide a flap 109. Flap 109 is selectively secured with similar flap 110 formed on the lower edge portion 111 of the movable rear panel 105 by suitable fastening means such as snaps 112. Although the fastening means mentioned above and shown in the drawings are in the form of snaps, it is envisioned that any other fastening means including Velcro fasteners or zippers could be used to selectively secure the panel members together.

In this embodiment of the invention, when it is desired to use the sleeping bag, the doll 21 is placed with the front body portion or panel 107 against a supporting surface and thereafter the snaps 106 are released thereby freeing the edge portion 104 of the movable rear panel member 105 as shown in FIG. 18. Thereafter, the sleeping bag 20 may be unfolded from its enclosed position between the fixed panel member 107 and the movable panel 105 and extended into a generally planar configuration.

With specific reference to FIG. 18, the rear panel member 105 includes a fixed edge portion 114 which is secured by stitching along the sides of the doll. As was previously discussed with respect to FIGS. 1–6, the arms 23 are secured to the fixed body panel 107. In order to permit movable panel member 105 to be reversed to form a pocket on the sleeping bag, an opening 30 is provided in the area adjacent the shoulder portion of the doll 31. Unlike the previous embodiments, only a single opening 30 is provided along the fixed side 114 of the movable panel 105. The opening 30 permits the arm 23 to be selectively extended therethrough so that movable panel 105 may be moved from the rear of the doll to the upper surface of the sleeping bag when the sleeping bag is in use. If desired, the opening 30 could be made in the movable panel adjacent side 114 thereof as opposed to being between the movable and fixed panel members as shown in FIG. 7.

With specific reference to FIG. 19, a rear movable panel member 120 is disclosed which is completely removable from engagement with other portions of the doll and sleeping bag. In this embodiment, the sides 121 and 122 of the panel member are releasably secured to the side portions of the doll by a plurality of fastening means 123. Additional fastening means are provided along the lower edge portions of the panel member for engaging portions of the fixed front panel member 107. When it is desired to remove the sleeping bag from its stored position between the fixed panel member and the movable panel member 120, the snaps along the sides and bottom portion thereof are released and the movable panel member is set to the side of the doll. Thereafter the sleeping bag may be unfolded into a general planar position after which the movable panel member may be secured to mating fastening means (not shown) on the upper portion of the sleeping bag.

I claim:

1. A bedding apparatus for covering a person while resting and which is convertible to a doll comprising cover means having upper and lower surfaces, said cover means being of a size to be used to cover the person, doll means secured to said cover means, said doll measn having head and body portions and first and second three-dimensional arm and leg means, said body portion of said doll means including movable panel member having first and second edges, said first edge being secured to said cover means, said second edge being movable spaced with respect to said cover means, securing means disposed along said second edge of said movable panel member for selectively securing said second edge of said panel member relative to said cover means, said cover means being foldable relative to said doll means, said movable panel member extending over and enclosing said cover means when said cover means is folded, whereby said cover means functions as a means for stuffing the body portion of the doll means thereby creating a three-dimensional doll-like three-dimensional figure.

2. The invention of claim 1 in which said head portion and said first and second arm and leg means are movably mounted with respect to said cover means and an opening through said movable panel member adjacent said first edge thereof through which said first arm means may be selectively extended.

3. The invention of claim 2 in which said cover means is a sleeping bag having upper and lower insulated portions.

4. The invention of claim 3 in which said cover means has an end portion, said head portion of said doll means being attached to said lower portion of said cover means so as to extend outwardly from said end portion and said body portion being secured to said upper portion of said cover means adjacent said end portion thereof.

5. The invention of claim 4 including means for releasably securing said head portion to either of said upper and lower insulated portions of said cover means.

6. The invention of claim 1 in which said body portion of said doll means includes a fixed panel member attached to the upper surface of said cover means, said fixed panel member having first and second side portions, said movable panel member extending outwardly from said first side of said fixed panel member, said fixed panel member forming an outer surface of said doll means when said cover means is enclosed within said body portion of said doll means.

7. The invention of claim 6 in which said cover means is a sleeping bag having upper and lower sections, said head and said first and second arm and leg means being movably mounted with respect to said cover means and at least one opening through said movable panel member adjacent said first edge thereof through which one of said arm means may be selectively extended.

8. The invention of claim 6 in which said first edge of said movable panel member is releasably secured to said cover means.

9. A three-dimensional doll which is convertible to a bedding apparatus for selectively covering a person comprising a head portion, a body portion, and first and second arm and leg means attached to said body portion, said body portion of the doll having front and back sections, said front section of said body portion having a front panel means which extends from adjacent said head to said leg means, said back section of said body portion including a movable panel means connected to said body portion adjacent said front panel means and which is movable with respect to said front panel means so as to extend behind the doll, fastening means for securing said movable panel means in closed relationship with said front panel means, a cavity defined between said movable panel means and said front panel means, a cover means connected to said body portion of the doll and completely housed within said cavity, said cover means having upper and lower surface and being of a size to cover a person, said cover means being selectively extended from within said cavity when said movable panel means is in open relationship with respect to said front panel means whereby said cover means normally serves as a means for stuffing said body portion of the doll and is selectively extended to be used as a bedding apparatus.

10. The invention of claim 9 in which said front panel means and said movable panel means are attached to said upper surface of said cover means, an opening between said movably panel means and said front panel means, said first arm means being selectively movable through said opening so that as said movable panel means is moved relative to said cover means said first arm means may be selectively reoriented through said opening.

11. The invention of claim 10 including second and third fastening means for selectively attaching said movable panel means to said head and between said leg means to said front panel means.

12. A bedding apparatus for covering a person while resting and which is convertible to a stuffed doll comprising a sleeping bag means having upper and lower portions, doll means mounted to said sleeping bag means and including head and body portions and front and back sides, said body portion of said doll means being attached to said upper portion of said sleeping bag, said head portion of said doll means is attached to said lower portion of said sleeping bag means said body portion having at least one movable panel means attached to said upper portion of said sleeping bag, said sleeping bag being seletively foldable to be positioned adjacent said back side of said doll means, and said movable panel means being movable from said front side of said doll means to said back side thereof to enclose said sleeping bag therebetween, said sleeping bag forming a means for stuffing at least said body portion of said doll means.

13. The invention of claim 12 in which said doll means includes first and second arm and leg means, said arm and leg means being attached to and extending from said body portion of said doll means so as to be movable with respect thereto.

14. The invention of claim 13 in which said movable panel means has first and second side edges, fastening means attached to said second side edge, said second side edge being releasably secured to said upper portion of said sleeping bag means.

15. The invention of claim 14 in which said movable panel means is removably attached to said upper portion of said sleeping bag means.

* * * * *